US008894412B1

(12) United States Patent
Malin et al.

(10) Patent No.: US 8,894,412 B1
(45) Date of Patent: Nov. 25, 2014

(54) SYSTEM AND METHOD FOR MECHANICALLY ACTIVATED LASER

(71) Applicants: Roger D. Malin, Phoenix, AZ (US); Ian F. Webb, Phoenix, AZ (US); Matthew D. Burlend, Chandler, AZ (US); Christopher M. Savarese, Scottsdale, AZ (US)

(72) Inventors: Roger D. Malin, Phoenix, AZ (US); Ian F. Webb, Phoenix, AZ (US); Matthew D. Burlend, Chandler, AZ (US); Christopher M. Savarese, Scottsdale, AZ (US)

(73) Assignee: Virtra Systems Inc., Tempe, AZ (US)

( * ) Notice: Subject to any disclaimer, the term of this patent is extended or adjusted under 35 U.S.C. 154(b) by 37 days.

(21) Appl. No.: 13/621,836

(22) Filed: Sep. 17, 2012

(51) Int. Cl.
*F41G 3/26* (2006.01)

(52) U.S. Cl.
USPC ..... 434/22; 434/11; 434/19

(58) Field of Classification Search
USPC ..... 434/11–27; 42/54, 57–58, 111–117, 42/146
See application file for complete search history.

(56) References Cited

U.S. PATENT DOCUMENTS 8,602,784 B2 * 12/2013 Dvorak ..... 434/18
8,608,474 B2 * 12/2013 Markert et al. ..... 434/18

* cited by examiner

*Primary Examiner* — Timothy A Musselman
(74) *Attorney, Agent, or Firm* — Wright Law Group, PLLC; Mark F. Wright

(57) ABSTRACT

A firearm simulation system for enhanced firearms training comprises at least one weapon with a mechanically activated laser. The system includes a normally closed laser activation circuit used in conjunction with a recoil kit. The normally closed laser activation circuit comprises a conductive seal, a ball bearing, and a recoil spring. The recoil spring presses or urges the ball bearing into contact with the conductive seal. The function of the laser activation circuit is mechanically triggered and the laser activation circuit is electrically connected to a light source (e.g., a laser light) and configured to activate the light source, simulating a projectile being fired from a weapon. When the trigger of the simulated weapon is pulled, a striker pin dislodges the ball bearing, moving it out of its original position is contact with the conductive seal. The displacement of the ball bearing by the striker pin, away from the conductive seal, creates an open circuit. The open circuit serves to activate the laser, simulating a projectile being fired from the simulated weapon.

20 Claims, 8 Drawing Sheets

DETAIL A
SCALE 2 : 1

| # | DESCRIPTION | # | DESCRIPTION | # | DESCRIPTION |
|---|---|---|---|---|---|
| | | 226 | BARREL BLOCK | 244 | POGO PIN |
| 210 | STRYKER PIN | 228 | BRASS END CAP | 246 | BATTERY SLEEVE |
| 212 | O-RING | 230 | BALL BEARING | 248 | BATTERY PACK |
| 214 | PISTON | 232 | STAND OFF | 250 | PCB FRONT |
| 216 | O-RING | 234 | CHARGE CHAMBER | 252 | SET SCREWS |
| 218 | TAILPIECE FASTENER | 236 | POGO PIN SPRING | 254 | LASER MODULE |
| 220 | O-RING | 238 | BRASS RING | 256 | LASER BARREL |
| 222 | GAS TUBE | 240 | BRASS CONTACT | 258 | CO2 MAGAZINE |
| 224 | TAILPIECE | 242 | PCB REAR | | |

SECTION A-A

SECTION B-B

SYSTEM AND METHOD FOR MECHANICALLY ACTIVATED LASER

CROSS REFERENCE TO RELATED APPLICATIONS

The present application is a continuation-in-part of U.S. patent application Ser. No. 13/230,834, which application was filed on 12 Sep. 2011 and which application is now pending, which application is a continuation-in-part of U.S. patent application Ser. No. 12/643,097, filed on 21 Dec. 2009, which application was issued as U.S. Pat. No. 8,016,592 on Sep. 13, 2011, which application is a continuation of "Threat Fire Simulation System," U.S. patent application Ser. No. 11/286,162, filed 22 Nov. 2005 which application, in turn, claims priority under 35 U.S.C. §119(e) to "Simulated Shot-Back Training Device," U.S. Provisional Patent Application Ser. No. 60/633,080, filed 3 Dec. 2004, all of which are incorporated by reference herein.

BACKGROUND OF THE INVENTION

1. Field of the Invention

The present invention relates generally to the field of firearms training and more specifically relates to the accurate and realistic simulation of firearm recoil during training 2. Related Art Due to current world events, there is an urgent need for highly effective law enforcement, security, and military training. Training generally involves practicing marksmanship skills with lethal and/or non-lethal weapons. Additionally, training involves the development of decision-making skills in situations that are stressful and potentially dangerous. Indeed, perhaps the greatest challenges faced by a trainee are when to use force and how much force to use. If an officer is unprepared to make rapid decisions under the various threats he or she faces, injury to the officer or citizens may result.

One training technique that has been in use for many years is the utilization of a simulation system to conduct training exercises. Simulation provides a cost effective means of teaching initial weapon handling skills and some decision-making skills, and provides training in real-life situations in which live-fire may be undesirable due to safety or other restrictions.

Simulation systems for such training have included many types of simulated weapons, including simulated weapons adapted from functional firearms such as pistols and rifles. In order to preserve the safety of the trainees and trainers in the simulate environment, simulated weapons will typically employ a simulated projectile that is used to replace the actual bullets that would be fired from a fully operational weapon. In most sophisticated training simulations, laser light is used to simulate the projectile.

These simulators often employ a simulated weapon that generates a safe, low-power light source (e.g., laser). The laser is configured to generate a sharp beam of light from the simulated weapon that can be projected onto almost any surface. Depending on the scenario, the target may be a few feet or many yards away from the trainee. In addition, these simulators will often employ one or more video screens that are configured to display various training scenarios to the trainee. Controlled by a computer system, the firearm training simulator system can track the trainee's response to the various scenarios, including the location of the laser light emitted from the simulated weapon. By tracking and reporting the performance of the trainee, it is possible to ascertain the accuracy of the trainee and well as reaction time and other parameters that are used to enhance the training for the trainee.

One problem encountered with most known training systems is the inability of the laser system to accurately simulate the recoil of a fully functional weapon. Many simulators use fully functional weapons that are modified with components that include a barrel body, internal valve, piston, modified magazine, interface block, spring and a shock sensor. Additionally, a laser insert is used to simulate the projectile that would be fired from the barrel of the weapon.

These modified training weapons are usually designed to work with a compressed gas (e.g., air, nitrogen or CO2) that is connected to the weapon and that can be quickly installed and removed from the weapon. In these training systems, the shock sensor is configured to activate the laser based on the shock that occurs when the hammer of the simulated weapon contacts the firing pin of the simulated weapon. However, in many cases, shock sensor used to activate the laser doesn't register the shock from the hammer throw, but will register the shock that occurs during the recoil cycle. This may be only a split second in time, but in that time, the barrel position has often changed significantly and the laser-generated projectile will register as being "off target."

The use of a shock sensor and compressed gas to simulate actual cycling of the weapon, while effective from a safety standpoint, does not always capture an the relationship between trigger pull and firing of the weapon, thereby lessening the overall realism and effectiveness of the training scenario. Without improvements to the current methods of simulating the firing of a weapon, including the recoil cycle, the results obtained from simulated firearms training systems will continue to be sub-optimal.

BRIEF SUMMARY OF THE INVENTION

A firearm simulation system for enhanced firearms training comprises at least one weapon with a mechanically activated laser. The system includes a normally closed laser activation circuit used in conjunction with a recoil kit. The normally closed laser activation circuit comprises a conductive seal, a ball bearing, and a recoil spring. The recoil spring presses or urges the ball bearing into contact with the conductive seal. The function of the laser activation circuit is mechanically triggered and the laser activation circuit is electrically connected to a light source (e.g., a laser light) and configured to activate the light source, simulating a projectile being fired from a weapon. When the trigger of the simulated weapon is pulled, a striker pin moves from a first position to a second position and dislodges the ball bearing, moving it out of its original position is contact with the conductive seal. The displacement of the ball bearing by the striker pin, away from the conductive seal, creates an open circuit. The open circuit serves to activate the laser, simulating a projectile being fired from the simulated weapon.

BRIEF DESCRIPTION OF THE SEVERAL VIEWS OF THE DRAWINGS

The preferred embodiments of the present invention will hereinafter be described in conjunction with the appended drawings, wherein like designations denote like elements, and.

DETAILED DESCRIPTION OF THE INVENTION

Figure 1:
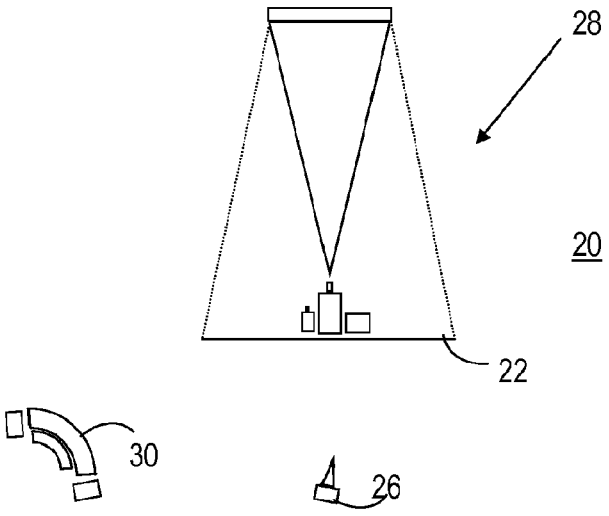
FIG. 1 shows a block diagram of a simulation system in which the present invention may be implemented.

A firearm simulation system for enhanced firearms training comprises at least one weapon with a mechanically activated laser. The system includes a normally closed laser activation circuit used in conjunction with a recoil kit. The normally closed laser activation circuit comprises a conductive seal, a ball bearing, and a recoil spring. The recoil spring presses or urges the ball bearing into contact with the conductive seal. The function of the laser activation circuit is mechanically triggered and the laser activation circuit is electrically connected to a light source (e.g., a laser light) and configured to activate the light source, simulating a projectile being fired from a weapon. When the trigger of the simulated weapon is pulled, a striker pin dislodges the ball bearing, moving it out of its original position is contact with the conductive seal. The displacement of the ball bearing by the striker pin, away from the conductive seal, creates an open circuit. The open circuit serves to activate the laser, simulating a projectile being fired from the simulated weapon. In the most preferred embodiments of the present invention, the conductive seal comprises a circular disk with a hole in the middle of the conductive seal (e.g., an O-ring shape). The outer diameter of the striker pin is cylindrical and is slightly smaller than the inside diameter of the circular opening in the center of the conductive seal. This allows the striker pin to pass through the opening in the conductive seal and contact the ball bearing without contacting the conductive seal.

The most preferred embodiments of the present invention may be deployed in conjunction with one or more firearms training simulation systems. At least one preferred embodiment of the firearms training system disclosed herein is utilized in conjunction with a training scenario, with the scenario typically including an offender holding a weapon.

Additionally, the firearms training system used in conjunction with the preferred embodiments of the present invention may be a "threat fire" simulation system. The term "threat fire" utilized herein refers to a situation within the training scenario in which the offender discharges his or her weapon toward the trainee, i.e., the offender is a "threat" to the trainee's perceived safety. In at least one preferred embodiment of the present invention, the threat fire training and simulation system comprises a computer controlled simulation and training system, using a wide variety of readily available computer hardware and peripherals to provide simulated threat scenarios for the training of individuals, including law enforcement and military personnel.

In at least one preferred embodiment of the present invention, the training scenario is a pre-recorded video sequence, including live actors and computer generated imagery (CGI) that is supplied to the end user in the form of electronic files (e.g., on DVD or other computer readable format) for use in firearms training. The pre-recorded video sequence of the training scenario is displayed to the trainee, presenting the trainee with a simulated environment that can be altered or adapted to meet the goals of the training exercise. For training purposes, the pre-recorded video sequence may be projected onto one or more video screens or, alternatively, projected onto a helmet visor or video display goggles donned by the trainee for a head-worn display system. With a head-worn display system, the use of video screens may be obviated, if desired.

In another preferred embodiment of the present invention, the training scenario comprises a live-action training session with simulated "force-on-force" trainees and participants using a wired or wireless communication link with standard laser-based training equipment, such as Multiple Integrated Laser Engagement System (MILES) and/or MILES 2000, which system and other similar systems are currently used by law enforcement agencies and military forces around the world. A laser-based training system, such as the MILES, provides tactical engagement simulation for direct fire force-on-force training using eye safe laser "bullets." This embodiment of the present invention may include pre-recorded video sequences but, in many cases, will be conducted in remote or isolated locations where video projection capabilities are limited or non-existent. In this case, the training scenario is typically a scripted attack or assault sequence using participants and trainees and various "real world" objects (e.g., buildings, vehicles, trees, etc.) to simulate the desired training environment.

FIG. 1 shows a block diagram of a simulation system 20 in which the present invention may be implemented. Simulation system 20 includes at least one screen 22, in front of which one or more participants, i.e., a trainee 26, may be positioned. A projection system 28 is associated with screen 22. Trainee 26 views screen 22 with video projected thereon via projection system 28, and must decide how to react to the subject matter presented within the video. Projection system 28 is operable, and the actions of trainee 26 may be monitored from, an instructor console 30 located a distance away from trainee 26. Instructor console 30 may comprise a tablet computer or other similar device.

The present invention is described in the context of its use with a single screen simulation system. It should be understood, however, that the specific simulation system is not a limitation of the present invention. Rather, the present invention may be readily implemented within a variety of existing and upcoming single screen and multiple screen simulation systems, including mixed-reality scenario training systems comprising screens and real world props such as mock cityscapes, doorways, windows, etc. as well as live actors used in addition to video playback of pre-recorded training scenarios.

Figure 2:
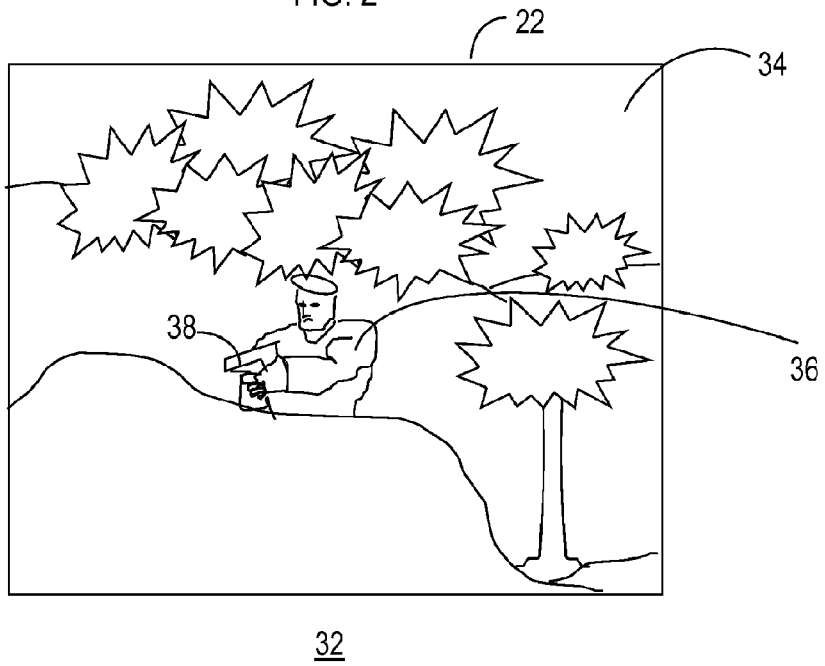
FIG. 2 shows an illustrative representation of a scene from a prerecorded video sequence, or scenario, that may be presented on a screen of the simulation system.
Figure 3:
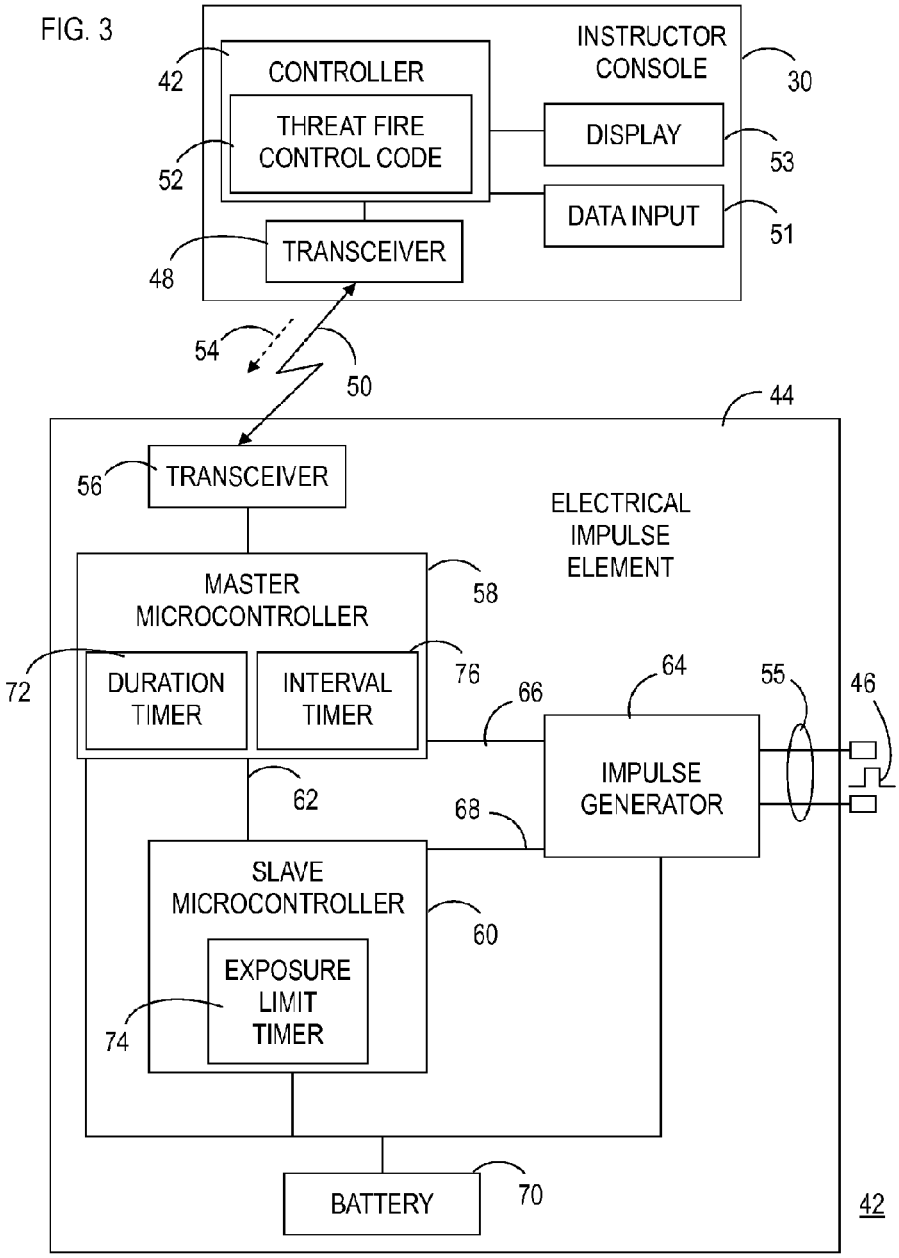
FIG. 3 shows a block diagram of a firearms training system for simulating a projectile impacting a user of the simulation system in accordance with a preferred embodiment of the present invention.

FIG. 2 shows an illustrative representation of a scene 32 from a prerecorded video sequence, or scenario 34, that may be presented on one or more screens 22 of simulation system 20 (FIG. 1). Scene 32 shows an offender 36 poised with a weapon 38 in hand. Trainee 26 (FIG. 1) must make a determination as to whether a shot from weapon 38 is imminent, and whether to shoot first or seek cover. For purposes of the following description, offender 36 discharges weapon 38. Although an actual projectile, or bullet, cannot discharge from weapon 38 of the prerecorded video of scenario 34, the present invention enables trainee 26 to experience the sensation of an impact of the projectile, so as to reinforce proper tactical decision-making FIG. 3 shows a block diagram of a threat fire system 40 for simulating a projectile impacting trainee 26 in accordance with a preferred embodiment of the present invention. Threat fire system 40 is most preferably a computer controlled system that includes a controller 42 operable from instructor console 30 and an electrical impulse element 44 worn by trainee 26 (FIG. 1). Electrical impulse element 44 is configured for physical contact with trainee 26 (FIG. 1), directly or indirectly, as discussed below, and is configured to impart a disabling non-disabling electrical pulse 46 to trainee 26. The term "non-disabling" utilized herein refers to a condition in which trainee 26 can feel pulse 46 as a sensation of mild pain, or as a sensation of more severe pain in which trainee 26 may be temporarily removed from action. However, pulse 46 is not incapacitating, such as the pulse delivered by a conventional stun gun. Electrical pulse 46 simulates an impact of the simulated projectile fired from weapon 38 (FIG. 2) by offender 36 (FIG. 1). Thus, electrical pulse 46 serves as notification to trainee 26 that he or she has been "shot."

In at least one preferred embodiment of the present invention, instructor console 30 is a computer-based system that includes a computer monitor for viewing various user interface screens that allow the instructor to configure, monitor, and control the training simulation. Instructor console 30 typically includes a first, or instructor, transceiver 48 in communication with controller 42. Instructor transceiver 48 is in communication with electrical impulse element 44 via a communication link 50. In a preferred embodiment, communication link 50 is a wireless link. However, a wired communication link may alternatively be employed. Controller 42 executes threat fire control code 52, which is operable by an instructor (not shown this FIG.) via a data input 51, such as a keyboard, mouse, and the like, and is viewable by the instructor via a monitor or display 53. Threat fire control code 52 may be a stand-alone computer program or may be incorporated into primary control code (not shown) for controlling the general operation of simulation system 20 (FIG. 1). Through the execution of threat fire control code 52, controller 42 generates and conveys a signal, represented by a dashed arrow 54, to electrical impulse element 44. Signal 54 enables activation of electrical impulse element 44, discussed below, to deliver non-disabling electrical pulse 46 to trainee 26 via a pair of electrodes 55, positioned at one or more locations.

Via instructor transceiver 48, the instructor can monitor the actions of trainee 26 and in communication with electrical impulse element 44 via a communication link 50 and the instructor can determine when and if a non-disabling electrical pulse 46 should be delivered to trainee 26. For example, in a training exercise where trainee is required to "take cover" in order to prevent exposure to hostile conditions, the instructor can activate electrical impulse element 44 and deliver non-disabling electrical pulse 46 to trainee 26 if trainee 26 does not "take cover" in an appropriate period of time.

Electrical impulse element 44, worn by trainee 26 (FIG. 1) includes a second, or trainee, transceiver 56 for receiving signal 54 via wireless communication link 50. A master microcontroller 58 is in communication with transceiver 56. Master microcontroller 58 is further in communication with a slave microcontroller 60 via a link 62. In addition, master microcontroller 58 selectively communicates with an impulse generator 64 via a first power lead 66. Similarly, slave microcontroller 60 selectively communicates with impulse generator 64 via a second power lead 68. Master microcontroller 58, slave microcontroller 60, and impulse generator 64 are powered by a rechargeable battery 70.

Impulse generator 64 may be a conventional stunner circuit capable of producing a 20,000 to 150,000 volt pulse, or shock. The internal circuit of a conventional stunner circuit is typically based either on an oscillator, resonant circuit and step-up transformer or diode-capacity voltage multipliers to achieve a continuous, direct or alternating high-voltage discharge.

Such stunner weapons may be utilized in law enforcement environments for subduing a person by administering a high-voltage, but low-current electrical shock. An electrical shock of sufficient duration provided by the stunner weapon "confuses" the human nervous system, thus incapacitating an individual. The high voltage is needed to transfer the electrical charge to the individual's body, and the current is kept low so that the individual will not be severely injured.

In the training environment of simulation system 20, impulse generator 64 does not produce the incapacitating shock of a conventional stunner weapon. Rather, a high voltage electrical pulse 46 is produced for a very brief duration, discussed below. The high voltage of electrical pulse 46 is critical so that pulse 46 may be felt through the clothing of trainee 26. However, the short duration mitigates the potential for incapacitating trainee 26 (FIG. 1).

Safety interlocks are important for the safe training application of system 40. Such safety interlocks may include watchdog processors that monitor for any component failure. If the watchdog processors detect a failure or problem, impulse generator 64 cannot be activated. In another preferred embodiment of the present invention, electrical impulse elements 44 may be automatically disabled by one or more sensors associated with electrical impulse elements 44. For example, an altimeter, a global positioning sensor ("GPS" sensor), an accelerometer, a moisture sensor, or other similar sensor may be incorporated into simulation system 20. In this preferred embodiment of the present invention, impulse elements 44 will be communicatively coupled to at least one or more disabling sensors.

Accordingly, when trainee 26 is standing on an elevated perch, platform, ladder, etc., the altimeter or GPS sensor would detect the potential for injury due to the distance above the ground. Although the electrical impulse generated by impulse elements 44 is generally non-disabling, the sudden exposure to the electrical simulation may startle trainee 26. If trainee 26 is in a precarious position or location, the trainee may be momentarily distracted and lose balance, etc. Similarly, if the moisture sensor detects a high level of moisture in the ambient surroundings, it can automatically disable the electrical impulse elements 44 until the moisture level is within an acceptable range. By temporarily disabling electrical impulse elements 44 based on the trainee's physical location, the safety of the training environment can be enhanced.

Threat fire system 40 includes a duration timer 72 communicatively coupled to and managed by master microcontroller 58 for monitoring a duration of activation of non-disabling electrical pulse 46, i.e., a delivery duration. Under normal operating conditions, delivery of pulse 46 is discontinued upon expiration of the delivery duration, as monitored at duration timer 72. Threat fire system 40 further includes a secondary exposure limit timer 74 managed by slave microcontroller 60. Exposure limit timer 74 ensures that the duration does not exceed a pre-programmed value, for example two and one half seconds. Should delivery of pulse 46 not be discontinued upon expiration of the delivery duration, as monitored at duration timer 72, delivery of pulse 46 will be discontinued when the duration reaches the pre-preprogrammed value, monitored at exposure limit timer 74. Thus, the dual timer capability of duration timer 72 and exposure limit timer 74 provides another safety interlock for limiting injury to trainee 26 (FIG. 1).

In addition, system 40 includes an interval timer 76 managed by master microcontroller 58. Interval timer 76 is utilized for controlling an interval between successive electrical pulses 46. Through the utilization of interval timer 76, electrical impulse element 44 will not reactivate for a set period after impulse generator 64 was last activated. Interval timer 76 may be set to, for example, fifteen seconds. Consequently, interval timer 76 provides yet another safety interlock for limiting injury to trainee 26.

In general operation, signal 54, in the form of a serial digital message, is sent from controller 42 over wireless communication link 50 via instructor transceiver 48. Ideally, the generation of signal 54 is coordinated with actions unfolding in scenario 34. For example, signal 54 may be automatically generated by controller 42 in response to an action in which offender 36 (FIG. 2) discharges weapon 38 (FIG. 2) when a period of time has elapsed and trainee 26 has not yet appropriately reacted to the situation. Alternatively, the instructor can "manually" activate electrical impulse element 44 from instructor console 30 (FIG. 3) via a program control window displayed on display 53 when offender 36 discharges weapon 38 and trainee 26 has not yet sought cover.

Signal 54 is received at trainee transceiver 56, is decoded, and is forwarded to master microcontroller 58. Signal 54 includes an identifier specifying electrical impulse element 44, a "pain setting" in the form of a delivery duration for non-disabling electrical pulse 46, and a CHECKSUM.

Master microcontroller 58 performs a validity check of signal 54 using CHECKSUM to determine whether errors occurred in transmission of signal 54 over wireless link 52. Master microcontroller 58 further authenticates the identifier specifying electrical impulse element 44 and determines whether the transmitted delivery duration is a logical value. If signal 54 is invalid, master microcontroller 58 ignores signal 54 and nothing happens.

However, if signal 54 is valid, master microcontroller 58 returns an acknowledge signal to controller 42 via wireless communication link 50. Master microcontroller 58 then applies power to first power lead 66 and commands slave microcontroller 60 via link 62 to apply power to second power lead 68. In addition, master microcontroller 58 starts duration timer 72 and starts interval timer 76.

In response to commanding from master microcontroller 58, slave microcontroller 60 returns an acknowledge signal to master microcontroller 58 via link 62, applies power to second power lead 68, and starts secondary exposure limit timer 74.

Power applied to first and second power leads 66 and 68, respectively, enables activation of impulse generator 64 to produce and deliver non-disabling electrical impulse 46 at pair of electrodes 55. Master microcontroller 58 commands slave microcontroller 60 to remove power from second power lead 68 when duration timer 72 expires to discontinue delivery of non-disabling electrical pulse 46. If slave microcontroller 60 fails to receive appropriate commanding within the pre-programmed value monitored by exposure limit timer 74, slave microcontroller 60 removes power from second power lead 68 to impose a forced discontinuation of the delivery of electrical pulse 46.

Although threat fire system 40 is shown as having only one electrical impulse element 44, it should be understood that controller 42 can control a number of individual electrical impulse elements 44. These multiple electrical impulse elements 44 can be physically coupled at various locations on trainee 26. For example, one of elements 44 could be coupled to the primary shooting arm of trainee 26. As such, should element 44 be activated, trainee 26 may be compelled to utilize his or her non-dominant arm. Alternatively, these multiple electrical impulse elements 44 can be physically coupled to multiple trainees 26 concurrently training in simulation system 20 (FIG. 1).

Figure 4:
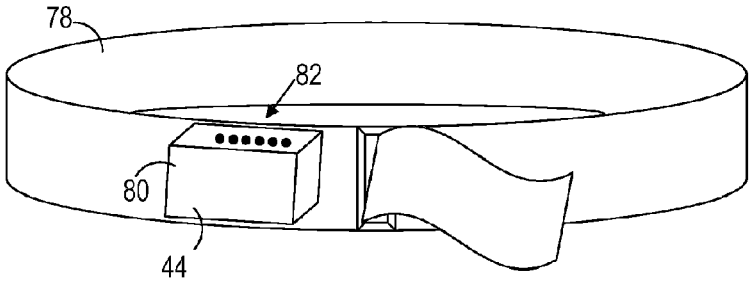
FIG. 4 shows a perspective view of an electrical impulse element of the system of FIG. 3 mounted on a user worn belt.
Figure 5:
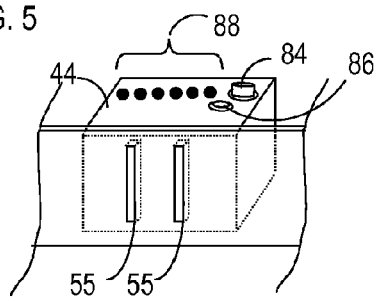
FIG. 5 shows a partial rear perspective view of the electrical impulse element mounted on the user worn belt.
Figure 6:
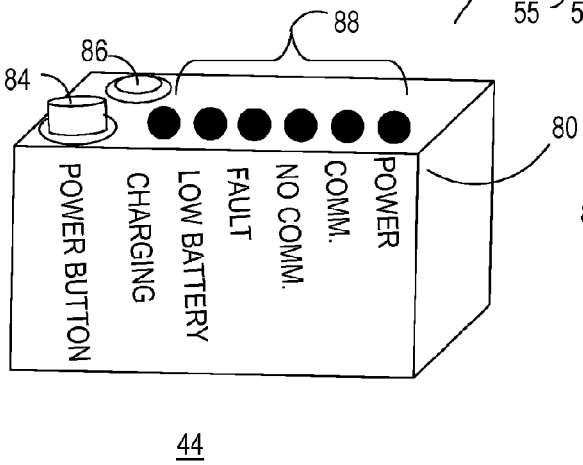
FIG. 6 shows a perspective view of an electrical impulse element.

Referring now to FIG. 4, FIG. 5, and FIG. 6, FIG. 4 shows a perspective view of electrical impulse element 44 of threat fire system 40 (FIG. 3) mounted on a user worn belt 78. FIG. 5 shows a partial rear perspective view of the electrical impulse element 44 mounted on user worn belt 78, and FIG. 6 shows a perspective view of the electrical impulse element 44.

The elements of electrical impulse element 44 are contained in a housing 80, which is in turn coupled to belt 78. Belt 78 provides means for securing electrical impulse element 44 to trainee 26 (FIG. 1). Pair of electrodes 55 are imbedded in a user facing side 82 of belt 78 so that electrodes 55 can be placed in physical contact with trainee 26. Although electrodes 55 are in physical contact with trainee 26, electrodes 55 need not contact the trainee's skin. For example, electrodes 55 may include thin wires sewn into user facing side of belt 78 for ensuring that non-disabling electrical pulse 46 is felt by trainee 26 through the clothing of trainee 26. Although described herein as a "pair of electrodes" the actual implementation of electrodes 55 is any type of conductive mechanism known to those skilled in the art that is capable of delivering the electrical impulse as described herein.

Further, in certain preferred embodiments of the present invention, electrodes 55 may be affixed to or embedded into a T-shirt or other garment worn by trainee 26, obviating the need for an external connection. This also allows for an increased numbers of electrical impulse elements 44 that do not need to be attached in a piece-meal fashion, as well as providing for more accurate correlation (e.g., increased granularity) between the actions of trainee 26 and the simulated impact created by electrical impulse elements 44. In another preferred embodiment of the present invention, one or more electrical impulse elements 44 may be embedded into a grip portion of a simulated weapon. In this fashion, there is no need for attaching electrodes 55 to trainee 26, since non-disabling electrical pulse 46 may be delivered to the grip portion of the simulated weapon.

Non-disabling electrical pulse 46 (FIG. 3) from electrodes 55 is capable of penetrating four or more layers of clothing (approximately one half inch of thickness), so that belt 78 can be conveniently placed on top of the clothing worn by trainee 26. Although belt 78 is shown with only one electrical impulse element 44 mounted thereon, belt 44 might include two elements 44 such that one is positioned in front of trainee 26 and one is positioned in the back.

Once belt 78 is secured with electrodes 55 in contact with trainee 26, electrical impulse element can be turned "on" via a pushbutton 84 located on an external surface of housing 80. In addition to pushbutton 84, housing 80 includes a charging port 86 for recharging battery 70 (FIG. 3) and a number of indicator lights 88. In an alternative embodiment, port 86 may be absent. In such a case, electrical impulse element 44 may be recharged via an inductive charge technique or may include non-rechargeable batteries. Indicator lights 88 include, for example, a "CHARGING" light that when blinking indicates that element 44 is charging and a "LOW BATTERY" light that when lit indicates that it's time to recharge element 44. Indicator lights can also include a "FAULT" light that when lit indicates a component failure within element 44, a "NO COMM" light that when lit indicates that there is no communication link between element 44 and controller 42 (FIG. 3), a "COMM" light that when lit that a communication link is present between element 44 and controller 42, and a "POWER" light that when lit indicates that power is currently on.

Figure 7:
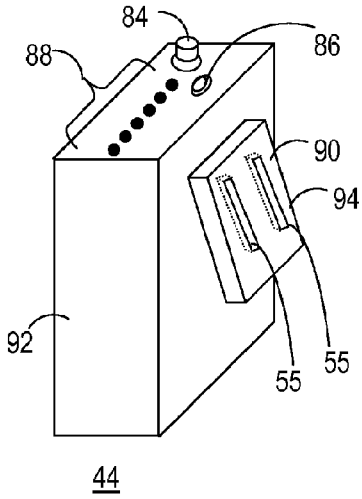
FIG. 7 shows a perspective view of the electrical impulse element of the simulation system that attaches to the user via a clip in accordance with an alternative embodiment of the present invention.

FIG. 7 shows a perspective view of electrical impulse element 44 of threat fire system 40 (FIG. 3) that attaches to trainee 26 (FIG. 1) via a clip 90 in accordance with an alternative embodiment of the present invention. The elements of electrical impulse element 44 are contained in a housing 92, to which clip 90 is coupled. Clip 90 may be a conventional spring clip that provides means for securing electrical impulse element 44 to trainee 26 (FIG. 1). Pair of electrodes 55 may be imbedded in a user facing side 94 of clip 92 so that electrodes 55 can be placed in contact with trainee 26.

Multiple housings 92 may be secured to trainee 26 via clips 90 at various locations, such as in the front, back, and on each bicep. In this manner, the instructor could activate controller 42 to enable receipt of signal 50 (FIG. 3) at any of electrical impulse elements 44 contained in housings 92, thus simulating shots impacting at various locations on trainee 26.

Figure 8:
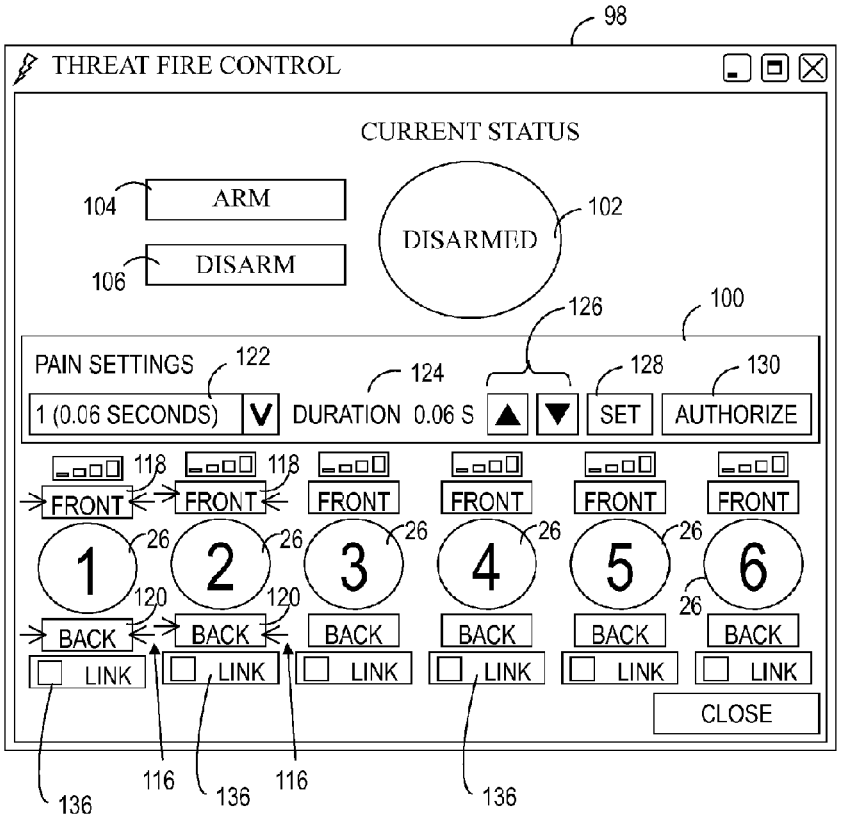
FIG. 8 shows a computer monitor screen shot image of a main window presented on a display of an instructor console.

FIG. 8 shows a screen shot image 96 of a main window 98 presented on display 51 (FIG. 3) of instructor console 30 (FIG. 3). Main window 98 is the primary opening view when a "threat fire control command" is selected on a main menu of the primary control code that controls the general operation of simulation system 20 (FIG. 1). Main window 98 includes a pain settings window 100 and a number of user fields, referred to as buttons, for determining the behavior of electrical impulse element 44 (FIG. 3). A secondary monitor (e.g. tablet screen) may also be deployed to display and activate the electrical pulse for one or more trainees.

Main window 98 opens with threat fire system 40 (FIG. 3) disarmed, as indicated by a current status indicator 102. Interactive buttons within main window can include an "arm" button 104 and a "disarm" button 106. To arm threat fire system 40, the instructor clicks on arm button 104. In response a pop up window of a password entry pane will be revealed.

Figure 9:
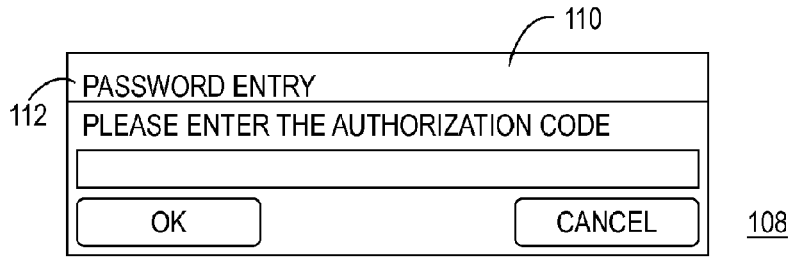
FIG. 9 shows a computer monitor screen shot image of a pop up window revealing a password entry pane.

FIG. 9 shows a screen shot image 108 of an exemplary pop up window 110 revealing a password entry pane 112. Per conventional procedures, the instructor is asked for an authorization password. After the instructor enters the authorization password and clicks "OK" in password entry pane 112, threat fire system 40 is armed.

Figure 10:
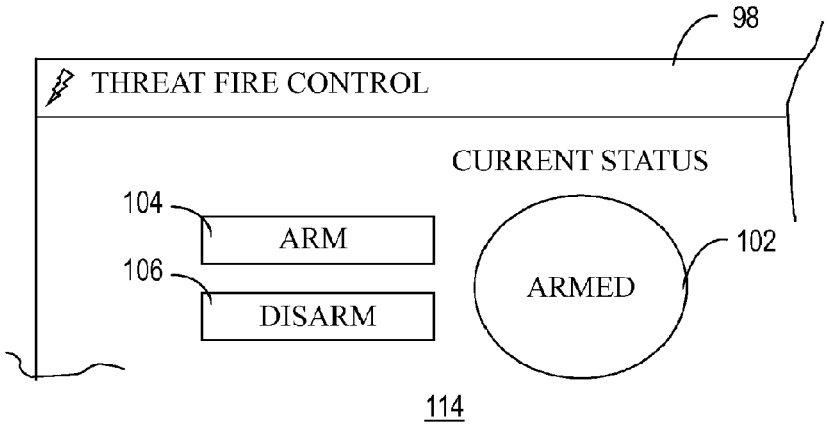
FIG. 10 shows a partial computer monitor screen shot image of the main window with the threat fire system prepared for operation.

FIG. 10 shows a partial screen shot image 114 of main window 98 with threat fire system 40 prepared for operation. Once armed, current status indicator 102 switches from "disarmed", as in FIG. 8 to "armed" as in FIG. 10.

Referring once again to FIG. 8, once threat fire system 40 is armed, controller 42 will connect via wireless communication link 50 (FIG. 3) to one or more available electrical impulse elements 44 (FIG. 3), and the individual controls for each of elements 44 will be enabled as appropriate.

In the exemplary illustration of FIG. 8, controller 42 can be enabled to communicate with up to twelve electrical impulse elements 44, that is two elements 44 (FRONT and BACK) for each of six trainees 26, labeled 1-6. FRONT indicates placement of one of electrical impulse elements 44 on the front of trainee 26, and BACK indicates placement of one of electrical impulse elements 44 on the back of trainee 26.

In this exemplary illustration, the connection of controller 42 with electrical impulse elements 44 is represented by outwardly radiating lines 116 about a FRONT button 118 and a BACK button 120 for each of two trainees 26, represented by the trainee identifiers "1" and "2" in main window 98. Although radiating lines 116 are shown herein, in an actual display, front button 118 and back button 120 may be normally colored red, and their color switches to green to indicate connection of controller 42 with particular impulse elements 44.

By utilizing pain settings window 100, the instructor can adjust pain settings for each of electrical impulse elements 44. The pain sensed by trainee 26 subjected to non-disabling electrical pulse 46 (FIG. 3) is affected by the delivery duration of pulse 46. A longer delivery duration results in a sensation of greater pain. Conversely, a shorter delivery duration of pulse 46 results in a sensation of less pain. In a group training exercise, the delivery duration could be extended to a greater length, such as, the exposure limit monitored by exposure limit timer 74 (FIG. 3). This lengthened duration, although non-disabling, may briefly put trainee 26 out of action, thereby simulating a situation in which trainee 26 is removed from combat.

Pain settings window 100 includes a duration select drop down menu 122, a duration readout field 124, and UP/DOWN buttons 126 to manually adjust the pain setting. In addition, pain settings window 100 includes a "SET" button 128 and an "AUTHORIZE" button 130 to enable the settings to change.

Figure 11:
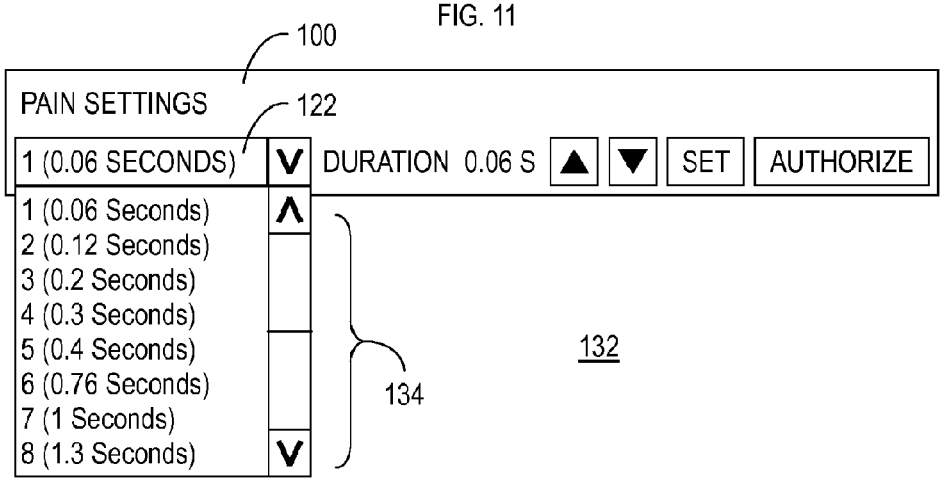
FIG. 11 shows a computer monitor screen shot image of a drop down menu of that includes a list of default pain settings.

FIG. 11 shows a screen shot image 132 of drop down menu 122 that includes a list of default pain settings 134. A pain setting 134 selected from drop down menu 122 is the number of seconds, or fractions of a second, (i.e., a duration) that non-disabling electrical pulse 46 (FIG. 3) will be delivered.

With reference back to FIG. 8, in general operation, the instructor may initially click on authorize button 130 to enter an authorization code (not shown). The instructor may then either change the pain setting to one of a number of default settings using drop down menu 122 or may manually adjust the pain setting using UP/DOWN buttons 126. Once the pain settings are adjusted, the instructor may optionally click on set button 128 that disables adjustment of the pain settings. As such, the pain settings cannot be re-adjusted without first entering the authorization code, again providing another safety interlock for protecting trainee(s) 26 from injury.

To fire, or activate, any of electrical impulse elements 44, an instructor can simply click any of the active front and back buttons 118 and 120, indicated herein by outwardly radiating lines 116. This will fire a desired one of electrical impulse elements 44 at the desired one of pain settings 134 and at the desired location.

If more than one trainee 26 is utilizing simulation system 20 (FIG. 1) to train concurrently within scenario 34 (FIG. 2), multiple elements 44 can be activated concurrently using a link feature. For example, checking two or more of link check boxes 136 enables all of the selected elements to fire when one of the front or back buttons 118 and 120, respectively, are clicked. For example, if link check boxes 136 are checked for two trainees 26, represented by the trainee identifiers "1" and "2", and front button 118 is clicked on trainee 26, represented by "2", then both elements 44 associated with front button 118 for both trainees 26, represented by the trainee identifiers "1" and "2", will activate. Thus, non-disabling electrical pulse 46 (FIG. 3) will be delivered to both trainees.

In the embodiment described above, controller 42 (FIG. 3) generates and transmits signal 54 over communication link 50 to electrical impulse element 44. Upon validation, signal 54 activates impulse generator 64 (FIG. 3) of electrical impulse element 44 to deliver non-disabling electrical pulse 46 (FIG. 3), pulse 46 simulating an impact of a projectile from weapon 38 (FIG. 2) discharged by offender 36 (FIG. 2) within scenario 34 (FIG. 2). Alternatively, in certain preferred embodiments of the present invention, the electrical pulse may simulate an exploding IED or shrapnel from an anti-personnel mine or other explosive device.

In an alternative preferred embodiment of the present invention, electrical impulse element 44 may interface via a wired or wireless communication link with standard laser-based training equipment, such as Multiple Integrated Laser Engagement System (MILES) and/or MILES 2000, which system and other similar systems are currently used by law enforcement agencies and military forces around the world. A laser-based training system, such as the MILES, provides tactical engagement simulation for direct fire force-on-force training using eye safe laser "bullets". When the present invention is employed in combination with MILES gear, controller 42 (FIG. 3) may be employed to arm threat force system 40 (FIG. 3), thus enabling receipt of an activation signal at electrical impulse element 44. However, the activation signal is actually generated and transmitted from the MILES gear.

For example, when the MILES gear registers a lethal hit, the MILES gear could transmit an activation signal via a wired or wireless communication link to electrical impulse element 44. This activation signal could then trigger impulse generator 64 (FIG. 3) to deliver non-disabling electrical pulse 46 (FIG. 3). Sensation of pulse 46 can give a trainee a more realistic sense and negative feedback of being "virtually" killed in action during training. A non-lethal shot could be set to trigger a very short pulse 46, whereas a "kill" could trigger a more pronounced pulse 46.

When electrical impulse element 44 is utilized in cooperation with MILES gear, pain settings 134 (FIG. 11) would not be adjustable by the trainees in the field. In addition, if a soldier attempted to remove element 44, element 44 could be set in a mode to activate a "dead" setting of the MILES gear, to deter tampering. Another option may be to have element 44 equipped with a sensor that triggers when element 44 is removed from the soldier, thereby letting element 44 register an event of tampering. Conversely, such an element should include authorization capability for allowing an authorized individual to remove element 44 from the soldier.

In addition, when electrical impulse element 44 is utilized in cooperation with MILES gear, Trainee 26 may be participating in a simulated live action drill or training session. In this case, trainee 26 is not viewing a video sequence on a screen but is, instead, viewing other trainees and participants wearing MILES gear and reacting to "real world" events as they unfold in the training scenario. In this environment, trainee 26 must decide how to react to the subject matter presented within the live action scenario. The laser "bullets" of the MILES system will activate electrical impulse element 44 whenever an opponent or other participant registers a "hit" on the trainee, as detected by the MILES laser engagement sensors. In this fashion, it is not necessary to have a video screen or an instructor console for activating electrical impulse element 44.

Figures 12, 13:
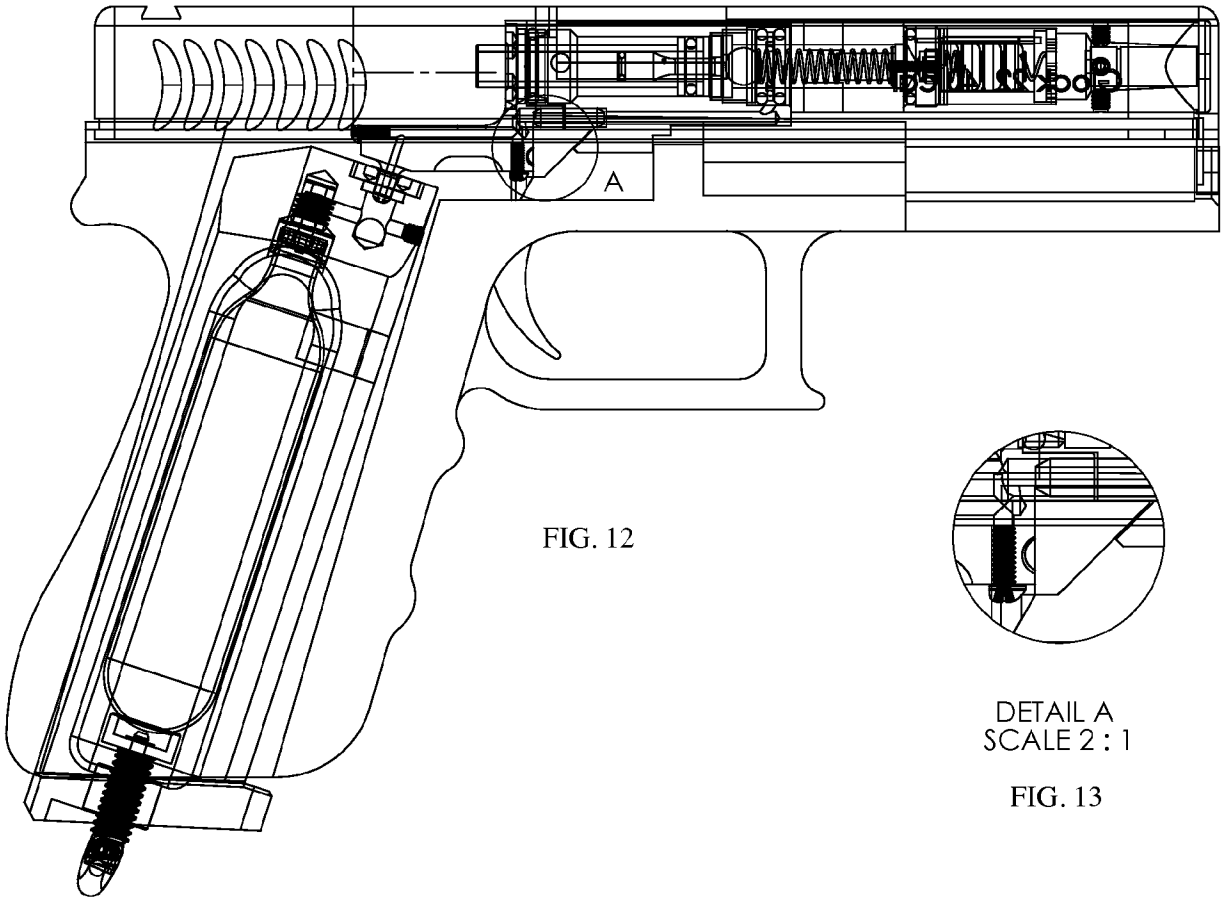
FIG. 12 is a cutaway view of a pistol that has been modified with a recoil kit using a mechanically activated laser in accordance with a preferred embodiment of the present invention.
FIG. 13 is a detail view of the trigger components used to activate the mechanical switch in the recoil kit of FIG. 12.

Referring now to FIG. 12, a cutaway view of a pistol that has been modified with a recoil kit using a mechanically activated laser in accordance with a preferred embodiment of the present invention is depicted. The pistol shown in FIG. 12 may be any type of pistol known to those skilled in the art and most commonly available pistols used by military and law enforcement personnel may be readily adapted for use. Further, although the present invention is explained herein via the example of a pistol, the same principals may be utilized in other weapon systems, including rifles, shotguns, etc. Regardless of the weapon system, any firearm training system that utilizes a light source to simulate the firing of a projectile from a weapon may be adapted to use a preferred embodiment of the present invention.

As shown in FIG. 12, a normally closed control circuit is electrically connected to control a light source (e.g., laser) and is configured to activate the laser to simulate the firing of the weapon. The operation of certain other components shown in FIG. 12, other than the mechanically activated switch, including the use of a compressed air source in the handle or grip of the pistol to operate the pistol slide and simulate the recoil of a projectile, are well known to those skilled in the art. As is typical, the compressed air may be self-contained or may be connected to an external gas supply, depending on the training environment. The normally closed circuit is most preferably contained on a printed circuit board housed inside the simulated weapon. However, the normally closed circuit may be housed externally to the simulated weapon, depending on the application. In either case, the normally closed circuit board will be powered by an electrical source (e.g., batteries) and used to control the operation of the light source. Once the flow of electricity in the normally closed circuit is interrupted by the movement of the ball bearing, the circuit will send a signal to the light source, actuating the light source.

Since the trigger of the pistol is mechanically coupled to the striker pin, when the trigger of the pistol is pulled by a trainee, the movement of the trigger will urge the striker pin towards the ball bearing. The ball bearing is normally held in place by the spring tension associated with the recoil spring, where the tension inherent in the recoil spring is sufficient to urge the ball bearing towards the conductive seal, completing the light source control circuit.

Referring now to FIG. 13, a detail view of the trigger components used to activate the mechanical switch in the recoil kit of FIG. 12 is depicted. As shown in FIG. 13, the trigger is mechanically coupled to the striker pin, forcing the striker pin to engage the ball bearing whenever the trigger is pulled to the break point. Once the striker pin engages and strikes the ball bearing, the force of the striker pin striking the ball bearing will move the ball bearing from a first position to a second position, breaking the light source control circuit that is used to control the firing of the light source. This will cause the laser to emit a light beam, simulating a projectile being fired from a weapon.

Figure 14:
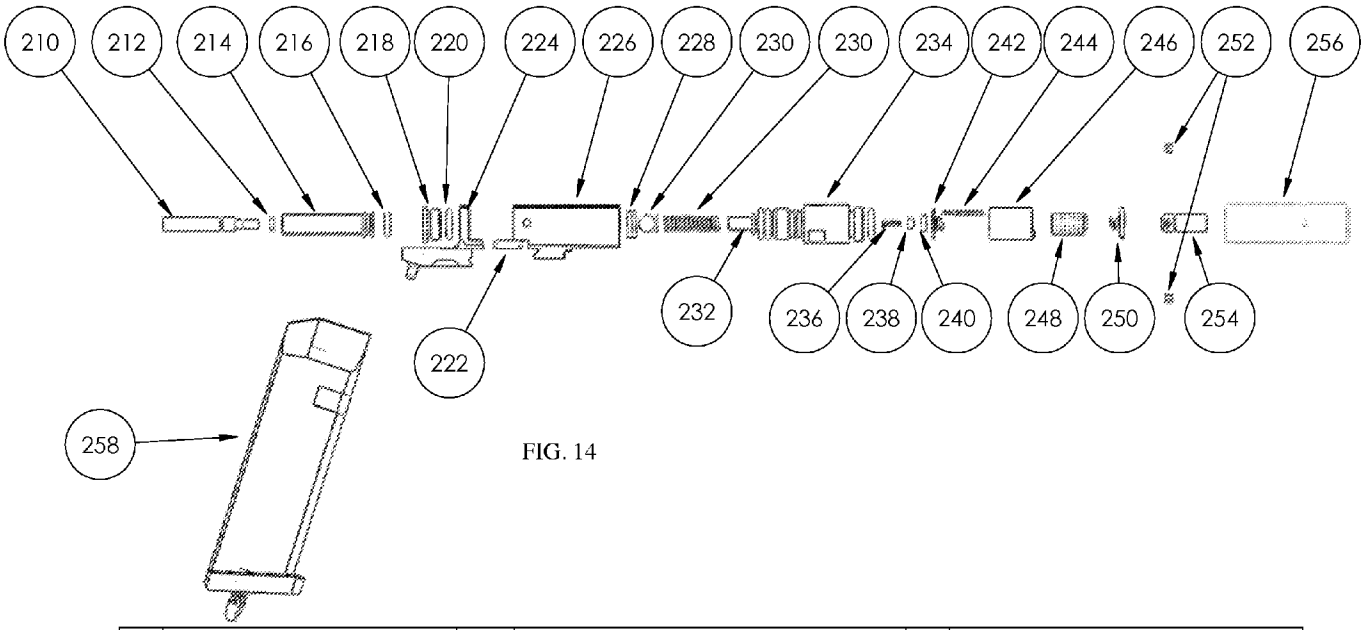
FIG. 14 is an exploded view (with labels) of the components in the recoil kit of FIG. 12.

Referring now to FIG. 14 an exploded view (with labels) of the components in the recoil kit of FIG. 12 is depicted.

Figure 16:
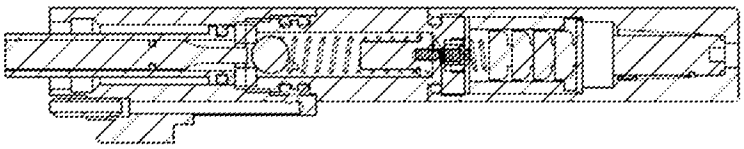
FIG. 16 is a sectional view of the pistol of FIG. 12 showing the striker pin in contact with a ball bearing in a mechanically activated switch in accordance with a preferred embodiment of the present invention.
Figure 15:
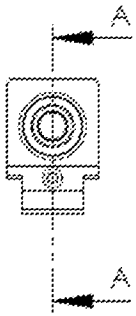
FIG. 15 is a view depicting the section lines for FIG. 16.

Referring now to FIG. 15, the section lines for the representation of the simulated weapon shown in FIG. 16 are depicted.

Referring now to FIG. 16, a sectional view of the pistol of FIG. 12 showing the striker positioned prior to contact with a ball bearing in a mechanically activated switch in accordance with a preferred embodiment of the present invention is depicted. As shown in FIG. 16, prior to the trainee pulling the trigger, the striker pin is not in physical contact with the ball bearing. In this position, the ball bearing acts as part of the laser activation circuit, which is a normally closed electrical circuit. With the ball bearing contacting the conductive seal, the electrical circuit operates but does not activate the laser.

It should be noted that any material that is capable of conducting electrical current may be used to manufacture the conductive seal. In the most preferred embodiments of the present invention, the conductive seal is a durable, relatively lightweight material (e.g., conductive rubber or rubberized conducting material, elastomers, elastomeric binders combined with various conductive fillers) with a low resistivity. It is important to note that the conductive seal should be flexible and conductive since it acts as a conductor of electricity and a seal to seal the chamber containing the pressurized gas.

The light source control circuit runs through the pressure chamber seal, the ball bearing, ball bearing spring, the brass ring connector, the circuit board spring, and to the body of the recoil chamber. The ball bearing is displaced from sealing the pressure chamber seal when the trigger is pulled by a trainee. The displacement breaks the electrical connection between the pressure chamber seal and the ball bearing and actuates the laser while simultaneously allow the release of pressurized gas from the source to initiate the recoil. This insures that the laser fires before the recoil action begins and translates into a more realistic and accurate shot being fired by the light source.

The conductive seal must be flexible enough to seal the pressure chamber and ensure that the recoil function of the simulated weapon works reliably while being conductive enough to complete a circuit for which can be used to make a mechanically activated light source control switch.

The ball bearing is electrically conductive and transfers electricity and also acts as a valve for releasing the pressurized gas to create the recoil. The recoil chamber body is also used as part of the light source control circuit to transfer electricity.

Figure 18:
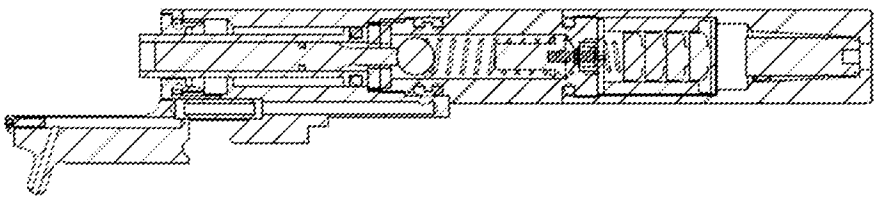
FIG. 18 is a sectional view of the pistol of FIG. 12 showing the movement of the striker pin to contact a ball bearing in a mechanically activated switch in accordance with a preferred embodiment of the present invention.
Figure 17:
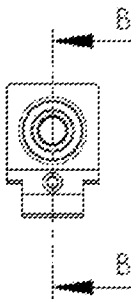
FIG. 17 is a view depicting the section lines for FIG. 18.

Referring now to FIG. 17, the section lines for the representation of the simulated weapon shown in FIG. 18 are depicted.

Referring now to FIG. 18, a sectional view of the pistol of FIG. 12 showing the movement of the striker pin to contact a ball bearing in a mechanically activated switch in accordance with a preferred embodiment of the present invention is depicted. As shown in FIG. 18, the striker pin contacts the ball bearing and will overcome the force of the spring on the other side of the ball bearing. This will force the ball bearing to move away from the conductive seal, opening the normally laser activation circuit. Once the normally closed circuit has been opened by the movement of the ball bearing away from the conductive seal, the circuit will send a signal to the laser, activating the laser and simulating a projectile being fired from the simulated weapon.

Aspects of the simulated firearm training system are described herein with reference to various microcontrollers, screens, and related computer program products. It will be understood that the command and control functions of the system described herein can be implemented by computer program instructions, executed by the master microcontroller (central processing unit or "CPU") in conjunction with the slave microcontroller and other related hardware components. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the control and operation of the threat fire system of the present invention.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the control and operation of the threat fire system of the present invention. The article of manufacture may include distribution via CD or DVD, for example, to be used in conjunction with a computer system to adapt the computer system to be used as a platform for implementing the threat fire simulation and training system of the present invention. In at least one preferred embodiment of the present invention, the article of manufacture comprises software (e.g., computer program instructions) stored on a computer readable storage medium that may be distributed to users of the threat fire system of the present invention.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the control and operation of the threat fire system of the present invention.

Additionally, various preferred embodiments of the program product may be configured to: create and modify multiple user and scenario databases; track, update and store data relative to specific simulations and training programs; configure and implement various search and retrieve functions for a plurality of search requests and determinations made by users of the threat fire simulation and training system; track and store information about various trainees; update and transmit search results to one or more users; and provide one or more user interfaces for accomplishing all of these functions. Various preferred embodiments may also include a plurality of structures that are disclosed herein in singular form, or a single structure disclosed herein as a plurality; those skilled in the art will recognize when this may be effective for some embodiments.

In the most preferred embodiments of the present invention, multiple video cameras or video monitors may be positioned in the training area. This will allow the instructors to record the activity of the trainees during the training simulation. The timing of the electrical impulses, as well as the trainee's response to the training scenario and the electrical impulses can also be captured for later review and analysis.

In summary, the present invention teaches a system for simulating the recoil of a firearm used in conjunction with a training environment. The system uses a mechanically activated switch to activate a laser, simulating a projectile fired from a weapon. In certain embodiments of the present invention, the system is configured to deliver a non-disabling electrical pulse from an electrical impulse element coupled to a trainee so that the trainee can distinctly detect a simulated impact of a projectile. The non-disabling electrical pulse provides a more realistic sense and negative feedback of being "shot" in action during a simulation training exercise. Since the electrical impulse elements are coupled to the trainees, at no time does the instructor need to take aim, thereby greatly simplifying the instructor's burden during a training exercise. Moreover no actual projectiles or laser projectiles are utilized for threat fire simulation, thereby reducing the potential for injury to the trainee. More than one electrical impulse element can be coupled at various locations on a single trainee and/or trainees to maximize the impact of the training experience. Furthermore, the threat fire system is readily incorporated into a variety of single screen and multiple screen simulation systems and its circuitry is relatively cost effective for manufacturing.

From the foregoing description, it should be appreciated that use-of-force training and projectile simulation system disclosed herein presents significant benefits that would be apparent to one skilled in the art. Furthermore, while multiple embodiments have been presented in the foregoing description, it should be appreciated that a vast number of variations in the embodiments exist. Lastly, it should be appreciated that these embodiments are preferred exemplary embodiments only and are not intended to limit the scope, applicability, or configuration of the invention in any way. Rather, the foregoing detailed description provides those skilled in the art with a convenient road map for implementing a preferred exemplary embodiment of the invention, it being understood that various changes may be made in the function and arrangement of elements described in the exemplary preferred embodiment without departing from the spirit and scope of the invention as set forth in the appended claims.

The invention claimed is:

1. A firearm training system comprising:

a simulated weapon comprising a normally open electrical control circuit, the normally open circuit comprising;

a conductive seal electrically coupled to the normally open circuit;

a ball bearing being electrically coupled to the normally open circuit via the conductive seal, the ball bearing being configured to selectively contact the conductive seal at a contact point; and a recoil spring, the recoil spring being electrically coupled to the normally open circuit via the ball bearing, the recoil spring contacting the ball bearing and urging the ball bearing to contact the conductive seal;

a light source, the light source being electrically coupled to the circuit and being selectively actuated by the circuit;

a striker, the striker being configured to selectively contact the ball bearing; and a trigger, the trigger being configured to engage the striker and urge the striker from a first position to a second position.

2. The firearm training system of claim 1 further comprising a source of compressed gas, the source of compressed gas being actuated by the trigger, the source of compressed gas being used to actuate a slide mechanism in the simulated weapon.

3. The firearm training system of claim 1 wherein the light source comprises a laser light.

4. The firearm training system of claim 1 further comprising:

a training scenario displayed to at least one user on at least one screen;

at least one electrical impulse element, the at least one electrical impulse element comprising:

a housing containing an impulse generator; and a pair of electrodes in electrical communication with each of the impulse generator and the at least one user; and at least one non-disabling electrical pulse generated by the impulse generator, the at least one non-disabling electrical pulse simulating an impact of a projectile, the at least one non-disabling electrical pulse being selectively delivered to the user via the pair of electrodes in response to at least one user reaction to the training scenario displayed to the at least one user.

5. The firearm training system of claim 1 further comprising a source of compressed gas, the source of compressed gas being actuated by the trigger, the source of compressed gas being used to actuate a slide mechanism in the simulated weapon, the source of compressed gas comprising at least one of a compressed air source, a compressed nitrogen source, and a compressed CO2 source.

6. The firearm training system of claim 1 further comprising at least one screen, the at least one screen depicting a threatening situation.

7. The firearm training system of claim 1 wherein the conductive seal comprises a rubberized material.

8. The firearm training system of claim 1, further comprising:

at least one video screen; and at least one pre-recorded video sequence projected onto the at least one video screen.

9. The firearm training system of claim 1 wherein the simulated weapon comprises at least one of a pistol comprising a mechanically activated laser to simulate a projectile being fired from the simulated weapon and a rifle comprising a mechanically activated laser to simulate a projectile being fired from the simulated weapon.

10. The firearm training system of claim 1, further comprising:

a plurality of video screens;

at least one pre-recorded video sequence projected onto the plurality of video screens; and a plurality of simulated weapons, wherein each of the plurality of simulated weapons comprises at least one of a pistol comprising a mechanically activated laser to simulate a projectile being tired from the simulated weapon and a rifle comprising a mechanically activated laser to simulate a projectile being fired from the simulated weapon.

11. A method comprising the steps of:

creating a normally closed electrical circuit, the electrical circuit being electrically connected to a recoil spring, a ball bearing, and a conductive seal;

pulling a trigger to move a striker pin;

moving the ball bearing by contacting the ball bearing with the striker pin, thereby opening the normally closed electrical circuit; and actuating a light source based on the opening of the normally closed circuit.

12. The method of claim 11 wherein the step of pulling the trigger to move a striker pin comprises the step of pulling the trigger to move the striker pin from a first position to a second position.

13. The method of claim 11 wherein the light source is a laser light source.

14. The method of claim 11 further comprising the step of discharging compressed gas from a compressed gas source.

15. The method of claim 14 wherein the compressed gas source comprises at least one of a compressed air source, a compressed nitrogen source, and a compressed CO2 source.

16. A simulated weapon, the simulated weapon comprising:

a normally open electrical control circuit, the normally open circuit comprising;

a conductive seal electrically coupled to the normally open circuit;

a ball bearing being electrically coupled to the normally open circuit via the conductive seal, the ball bearing being configured to selectively contact the conductive seal at a contact point; and a recoil spring, the recoil spring being electrically coupled to the normally open circuit via the ball bearing, the recoil spring contacting the ball bearing and urging the ball bearing to contact the conductive seal;

a light source, the light source being electrically coupled to the circuit and being selectively actuated by the normally open circuit;

a striker, the striker being configured to selectively contact the dislodge the ball bearing; and a trigger, the trigger being configured to engage the striker and urge the striker from a first position to a second position.

17. The simulated weapon of claim 16 further comprising a source of compressed gas coupled to the simulate weapon, the source of compressed gas being actuated by the trigger, the source of compressed gas being used to actuate a slide mechanism in the simulated weapon.

18. The simulated weapon of claim 16 wherein the source of compressed gas comprises at least one of a compressed air source, a compressed nitrogen source, and a compressed CO2 source.

19. The simulated weapon of claim 16 wherein the light source comprises a laser light.

20. The simulated weapon of claim 16 wherein the conductive seal comprises a rubberized material.

* * * * *